United States Patent [19]

Branch

[11] 4,332,496

[45] Jun. 1, 1982

[54] BOW PENCIL

[76] Inventor: John K. Branch, 2003 Maine Ave., Kenner, La. 70062

[21] Appl. No.: 262,484

[22] Filed: May 11, 1981

[51] Int. Cl.[3] ..... B43K 29/00

[52] U.S. Cl. ..... 401/52; 401/195; 84/282

[58] Field of Search ..... 401/49, 52, 195, 292, 401/149; 84/262, 263, 170

[56] References Cited

U.S. PATENT DOCUMENTS

| | | | |
|---|---|---|---|
| 354,800 | 12/1886 | McDonald | 401/52 |
| 920,249 | 5/1909 | Bishop | 401/52 |
| 2,401,750 | 6/1946 | Dye | 401/195 |
| 2,820,388 | 1/1958 | Rolland | 84/282 |
| 3,545,330 | 12/1970 | Nosco | 84/283 |
| 3,919,912 | 11/1975 | Darling | 84/282 |

*Primary Examiner*—William Pieprz
*Attorney, Agent, or Firm*—Charles C. Garvey, Jr.

[57] ABSTRACT

A music marking pencil is provided for use in combination with a violin bow or the like. The device attaches to the hand held end portion of a violin bow or the like and can be used by the musician to mark his music or perform similar writing tasks as needed. The device provides a pencil which can be a threaded mechanical mechanism affixed at the end portion of the violin bow which is normally hand held. The pencil aligns itself with the central axis of the bow with the pencil marking tip protruding beyond the hand held end portion of the bow. In the preferred embodiment, the pencil structure replaces the bow screw which normally adjusts tension of the bow hair. Thereafter, the bow pencil additionally provides the hair adjustment function.

6 Claims, 8 Drawing Figures

BOW PENCIL

BACKGROUND OF THE INVENTION

1. Field of the Invention

The present invention relates to musical instruments, and more particularly relates to the bow which is used in order to operate musical instruments of the class which includes violins, violas and the like. Even more particularly, the present invention relates to violin (and like) bows in which a pencil is provided at the hand held end portion of the violin bow as an aid to the musician for marking music and like writing functions.

2. General Background and Prior Art

Many string type instruments utilize a bow in order to produce the desired sound from the instrument. The musical instruments in this class include violins, violas, cellos, basses and the like. The bow as used with the violin, for example, has a threaded screw portion at the end adjacent the gripping surface. This can be removed easily with all bows and suitable writing instrument threadably inserted therein.

Musicians using string instruments such as violins, cellos, and the like utilize a bow which can be quite expensive, costing many thousands of dollars. The bow generally has a "bow screw" portion which is the only movable portion of the bow, and is rotated by the musician to vary the tension in the bow hairs.

A problem arises as to protection of this valuable violin or like bow in that during rehearsals the musician is required to frequently stop his music and make notations on his sheet music as required. This is an awkward function which requires the musician to set down his bow and pick up a pencil to make the necessary notations, thereafter retrieving the bow. Since the violin itself is much more expensive and valuable than the bow itself, the musician will not likely set down the violin but will rather set down the bow.

Many of these violin bows are antiques, and are very expensive, being manufactured generally by hand by bowmakers. Because of the artistic ability necessary to construct the bow, and because of the fact that a great deal of time is required, bows are generally quite expensive, and many in use today are quite old dating to the 18th or 19th century.

Thus, a problem is presented to the art in that some protection for the bow is required when the musician necessarily must make written notations on his sheet music during rehearsals and like functions.

Prior art devices have been patented which teach the general use of a marker of some sort attached to a violin bow. Such prior art devices, however, do not anticipate the present invention. One prior art device in U.S. Pat. No. 3,545,330 issued to Jeanne Nosco and entitled "Violin Bow Teaching Attachment". The Nosco patent provides chalk markers attached at the end portion of the violin bow opposite the gripping surface. In the Nosco patent, the markers are opposite the gripping end of the bow, the purpose of the markers being to trace a pattern on a wall or like adjacent surface in order to show the manner in which the violin is played and therefore use the device as a teaching apparatus.

3. General Description of the Present Invention

The present invention provides a pencil or like writing means adjacent the gripping surface end portion of the violin bow. Thus, the user can make notes on his music and mark them as desired by using the same hand with which the bow itself is normally gripped. This would not be possible with the Nosco patent which provides chalk like markers at the opposite end portion of the violin bow from that portion which is gripped.

The present invention provides, for example, a mechanical pencil which can be threadably operated to protrude or retract as desired a lead pencil type writing tip portion which can perform the desired necessary marking functions. After use of the bow, the marking tip can be retracted for its protection and to thereafter prevent undesirable marking on objects other than the music, for example, when the bow is not in use.

In the preferred embodiment, the bow pencil replaces the conventional bow screw which normally adjusts the tension on the bow hairs as is known in the art. The bow screw is a generally octagonal structure which provides a gripping surface for the gripping and rotation thereof by the musician to adjust the bow hairs as is desirable.

In the preferred embodiment, a bow pencil structure is provided having an elongated shaft which replaces the shaft portion of the conventional bow screw and attaches thereto. Thus, the bow pencil of the preferred embodiment performs both the adjustment function and the writing function as above described.

In an alternative embodiment, a bow pencil structure is provided which can attach to the bow screw directly without its removal.

Such a structure could be rotated or moved from an operable to an inoperable position if desired.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1A:
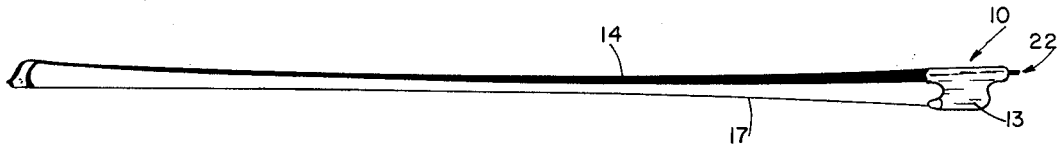
FIG. 1A is a partial perspective view of the preferred embodiment of the apparatus of the present invention attached to the gripping surface portion of a typical bow.
Figure 1B:
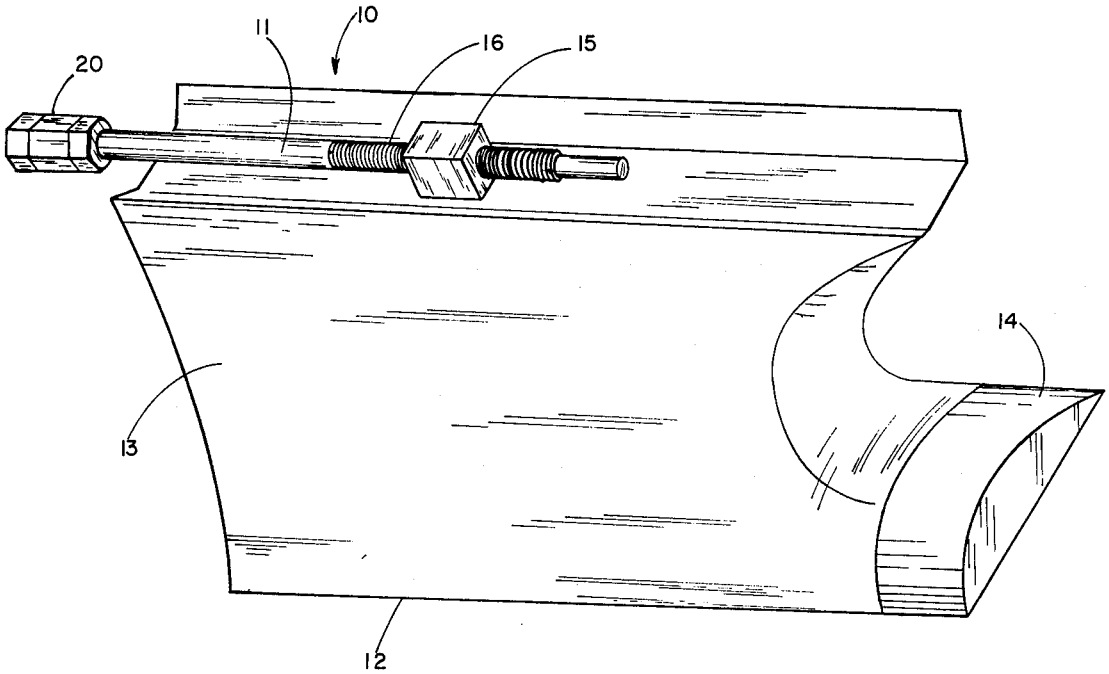
FIG. 1B is a partial perspective view of the preferred embodiment of the apparatus of the present invention illustrating attachment to the bow frog portion of a conventional viol bow.

The preferred embodiment of the present invention designated generally by the numeral 10 in FIGS. 1A–1B is illustrated as attached to the gripping end portion 12 of a typical violin bow or like viol bow 14. The gripping end 12 provides a gripping surface 13 which can be held by the musician in normal operation. The gripping end 12 is sometimes known as a "bow frog". As can best be seen in FIG. 1B, pencil 10 is attached by means of threaded shaft 11 to its receiving and supportive threaded mount 15. Mount 15 is attached to bow frog 12 and provides normally the place for attachment of a bow screw for the adjustment of bow hair 17. Mount 15 is provided on all conventional violin type bows 14 having an adjustment bow screw normally attached at mount 15. The bow screw is removed and bow pencil 10 having a correspondingly threaded shaft 11 is attached to mount 15 with mount 15 providing a firm support into which shaft 11 can be threadably mounted at threads 16. Threads 16 of shaft 11 would correspond with and register into similar threads provided on the interior portion of mount 15 as is known in the art, since mount 15 normally houses a conventional bow screw for adjustment.

The tip portion of pencil 10 provides a housing 20 in which a writing tip 22 is protectively held. Writing tip 22 can be of any suitable inscribing material such as, cylindrical lead or the like as is used in conventional drafting pencils. Tip 22 is shown in an operative position in FIG. 3 and retracted and in an inoperative position in FIGS. 4, and 6 with respect to the alternative embodiment.

Figure 2:
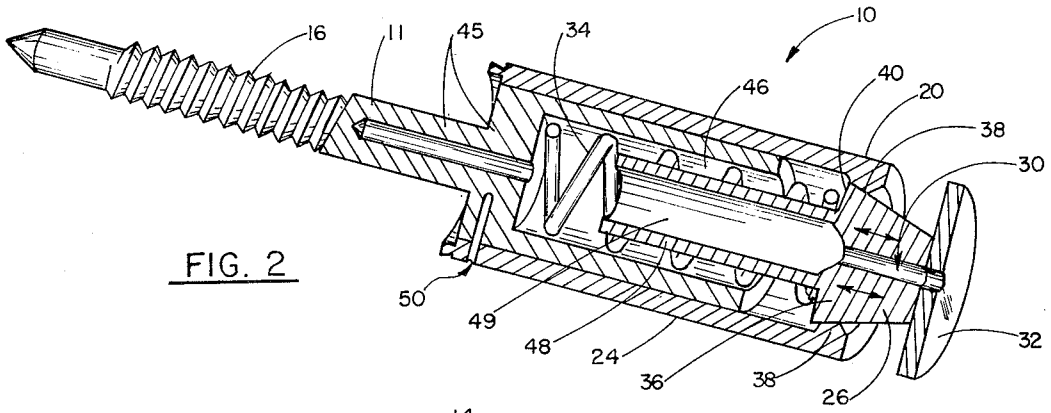
FIG. 2 is a perspective sectional view of the preferred embodiment of the apparatus of the present invention.
Figure 2A:
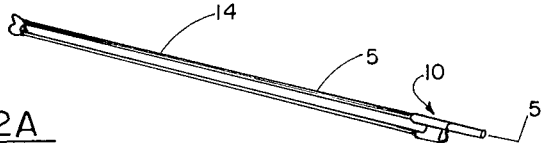
FIG. 2A is a perspective view of a typical viol or violin bow having the bow pencil apparatus of the present invention attached thereto.

As can best be seen in FIG. 2, housing 20 is comprised of a cover member 24 into which a lead holder 26 is inserted and attached for movement.

In the preferred embodiment, shaft 11 can be aligned axially with the longitudinal axis of bow 14, (Note FIGS. 1A and 1B). Thus, the pencil 10 is comfortably attached to bow 14 in such a way that the operator can hold the bow in line with the pencil and make notes on his music or as desired without the bow 14 interfering in the writing operation, since it will protrude behind the hand in much the same fashion as an elongated pencil. It is mostly preferable however that the pencil 10 be located at the end of bow 14 near gripping surface 13. Thus, the pencil will be in close proximity to and readily available for use by the musician.

Housing 20 can be generally cylindrical, but can be octagonal in section on the outside, to correspond with the octagonal shape of generally known and conventional bow screws as is known in the art. Thus, the outer octagonal or hexagonal surface could provide a gripping surface to aid in the adjustment function which bow screw 10 provides in addition to its marking function as will be described more fully hereinafter.

Figure 3:
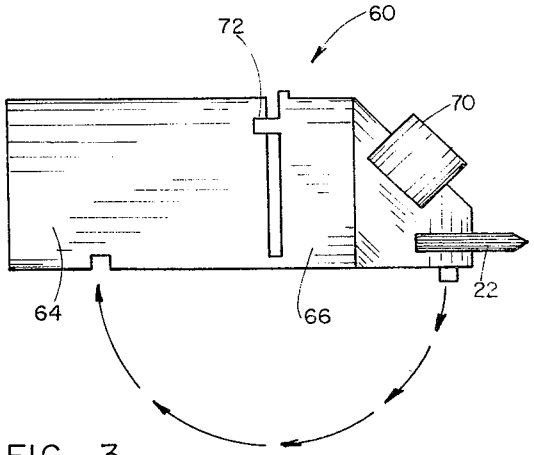
FIG. 3 is a front view of an alternative embodiment of the apparatus of the present invention.
Figure 4:
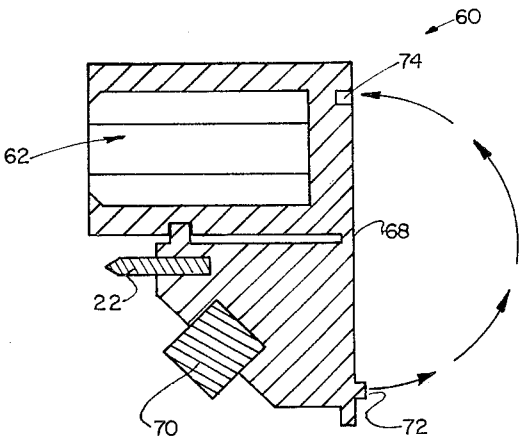
FIG. 4 is a sectional view of an alternative embodiment of the apparatus of the present invention.

Housing 20 provides a lead holder 26 having an inner bore 30 into which a suitable writing structure such as a cylindrical piece of lead 22 as is seen in FIGS. 3 and 4 with respect to the alternative embodiment. Lead 22 is not seen in FIG. 5, but it should be understood that it will be generally cylindrical providing a writing tip and will be insertably held within bore 30, having a diameter slightly smaller than the diameter of cylindrical bore 30.

Lead holder 26 is generally conically shaped or frusto-conically shaped having a depression head 32. The frusto-conical shape of lead holder 26 allows it to be movably slid within housing 20 by pressure applied to head 32. Pressure on head 32 will depress spring 34, relieving the pressure on the base 36 portion of holder 26, thereby relieving the inward pressure which causes a slight constriction of bore 30. Such a constriction of bore 30 is seen when spring 34 urges holder 26 outwardly with base portion 36 of holder 26 abutting on anular shoulder 38.

The underside of lead holder 26 provides an annular collar 40 which forms an attachment for spring 34 thereagainst as is best seen in FIG. 2.

Shaft 11 provides a housing mount 45 which is generally annular, corresponding to the inner bore 46 of housing 20. Preferably, the fit of housing mount 45 into bore 46 of housing 20 will be a frictional tight fit, which can be overcome by pulling apart by the musician. The frictional fit will not of course be overcome by the spring force provided by spring 34 while holding lead holder 26 in its tight operable position to constrict bore 30 and hold a portion of lead pencil 22 therein.

Lead holder 26 provides an annular lead holding case 48 which is merely a depending cylindrical vessel portion having an inner space 49 into which portions of lead pencil can be housed for future use.

Note further from an inspection of FIG. 2 that a bore 50 can be provided intersecting both housing 20 and housing mount 45. Bore 50 could be provided with a lock pin (Not Shown) which would aid in the attachment of housing mount 45 and housing 20.

It can be seen from the above by one skilled in the art, that bow pencil 10 replaces the conventional bow scew at its threaded mount 15, thereafter performing both the hair adjustment and writing function as is desirable.

The bow pencil 10 of the preferred embodiment can easily be attached to any conventional violin bow or the like by simply unscrewing the adjustment bow screw and threadably attaching the bow pencil 10 as is illustrated in FIGS. 1A, 1B, 2 and 2A thereto.

An alternative embodiment is ilustrated in FIGS. 3–6. The alternative embodiment provides a bow pencil 60 which can be attached over the conventional bow screw, the pencil 60 providing recess 62 which can be attached to a conventional bow screw. As is known in the art, the bow screw has a hexagonally or octagonally shaped adjustment head. Preferably recess 62 would be sized to correspond to the size and shape of the bow screw adjustment head and would slidably fit thereover.

Bow screw 64, provides a mount portion 60 for which attaches to the bow screw, and hingedly attached writing portion 66. In the preferred embodiment, bow pencil 60 could be injection molded of plastic, for example, with a hinge 68 allowing the writing portion 66 to pivot (See arrows, FIGS. 3 and 4) from an operative (See FIG. 3) to an inoperative (See FIG. 4) position. Note further that bow pencil 60 provides an eraser 70 which could be attached by gluing or like means if desirable.

A catch member 72 would lock bow pencil 60 in its operative position (See FIG. 3) by frictionally engaging and holding at recess 74 (See FIG. 8). A second recess 75 and latch 73 would lock bow pencil 60 in its inoperative position.

Figure 5:
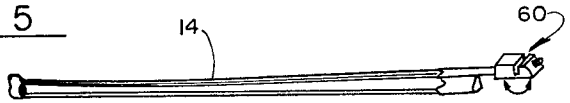
FIG. 5 is a perspective view of a typical violin bow showing the alternative embodiment of the apparatus of the present invention in an operable writing position; and, FIG. 6 is a perspective view of a typical violin bow showing the alternative embodiment of the apparatus of the present invention in an inoperable folded position.
Figure 6:
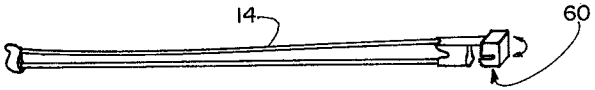

In FIGS. 5 and 6, there can be seen the bow pencil 60 of the alternative embodiment, mounted to a typical violin bow 14 at the bow screw portion thereof.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A bow pencil comprising:

a. a bow pencil shaft, said shft being threaded and adopted to be attached to the bow frog portion of a viol bow, replacing the bow screw;

b. a means attached to said bow shaft for marking on a surface, said pencil shaft and said means being attached to said bow at the gripping end portion thereof, replacing the bow screw, rotation of said means and attached shaft effecting an adjustment of the viol bow hair.

2. The bow pencil of claim 1 wherein said means is comprised of lead holder means attached to said shaft for holding a piece of pencil lead.

3. The bow pencil of claim 1 wherein said means is comprised of:

a. an elongated shaft attached to said bow at the gripping end portion thereof;

b. a housing attached to said shaft;

c. lead holding means within said housing for holding a piece of pencil lead.

4. The apparatus of claim 3 wherein said means is further comprised of a housing on said shaft and a lead holder movable within said housing, movement of said holder allowing a secured piece of pencil lead to move from an operative to an inoperative position.

5. The apparatus of claim 1 wherein said means is substantially axially aligned with the longitudinal axis of said bow.

6. The apparatus of claim 3 wherein said means is substantially axially aligned with the longitudinal axis of said bow.

* * * * *